US008118614B2

(12) United States Patent
Sawada

(10) Patent No.: US 8,118,614 B2
(45) Date of Patent: Feb. 21, 2012

(54) MOLDED CONNECTOR

(75) Inventor: Hisashi Sawada, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/822,623

(22) Filed: Jun. 24, 2010

(65) Prior Publication Data

US 2011/0021076 A1 Jan. 27, 2011

(30) Foreign Application Priority Data

Jul. 21, 2009 (JP) ..... 2009-170184

(51) Int. Cl.
*H01R 13/40* (2006.01)

(52) U.S. Cl. ..... 439/589

(58) Field of Classification Search ..... 439/587, 439/589, 281, 736, 282, 584, 581
See application file for complete search history.

(56) References Cited

U.S. PATENT DOCUMENTS 6,932,657 B2 8/2005 Mizutani

FOREIGN PATENT DOCUMENTS

JP 2008-258103 10/2008

*Primary Examiner* — Alexander Gilman
(74) *Attorney, Agent, or Firm* — Gerald E. Hespos; Michael J. Porco

(57) ABSTRACT

A molded connector (20) has a molded connector main body 21 including a terminal (22) of a cable (40) and a molded resin section (26) molded onto a portion of the terminal (22) and a distal end of the cable (40). A barrel-like cap (50) has a cable insertion hole (50β) for passing the cable (40) and is attached to the molded connector main body (21) so as to cover an outer periphery of a support section (37) of the molded connector main body (21). An annular seal (55) is provided on an inner surface of the cap (50). The seal (55) closely contacts and seals an outer periphery of the cable (40).

7 Claims, 6 Drawing Sheets

MOLDED CONNECTOR

BACKGROUND OF THE INVENTION

1. Field of the Invention

This invention relates to a molded connector.

2. Description of the Related Art

U.S. Pat. No. 6,932,657 discloses a molded connector with a terminal metallic member and a coated electrical cable. An insulation sheath is stripped from the coated electrical cable to expose a core wire, and the terminal metallic member is secured to the core wire. A synthetic resin then is molded on the portion of the terminal metallic member secured on the distal end of the coated electrical cable. The insulation sheath of the coated electrical cable generally is made from a different from a material than the molded resin layer of the prior art molded connector. As a result, adhesion bond between the insulation sheath and the molded resin layer is not always sufficient. A clearance will be created between the electrical cable and the molded resin layer, particularly in an extended portion of the electrical cable, if the electrical cable repeatedly is bent significantly. Consequently, there is a possibility that a waterproofing function will be lowered.

Accordingly, JP 2008-258103 attempts to address the problems of U.S. Pat. No. 6,932,657 by applying a seal agent to an extended portion of the electrical cable in a connector housing. The seal agent seals a clearance between the extended portion of the electrical cable and the molded resin layer to improve a waterproofing function. However, the seal agent requires a long drying time, and hence lengthens the producing process. Further, temperature and humidity must be controlled for optimal drying of the seal agent, thereby adding to the production cost.

In view of the above problems, an object of the invention is to provide a molded connector that can lower a producing cost and can perform waterproofing.

SUMMARY OF THE INVENTION

A molded connector in accordance with the invention has a molded connector main body that includes a metallic terminal secured to a core wire that has been exposed by stripping an insulation sheath from a coated electrical cable. A molded resin layer is formed by molding synthetic resin on a section that contains a secured portion of the terminal and a distal end of the coated electrical cable. A barrel-like cap is attached to the molded connector main body and covers an outer periphery of a support of the molded connector main body. The cap has an electrical cable insertion hole for passing the electrical cable. An annular seal is provided on an inner surface of the cap for closely contacting and sealing an outer periphery of the coated electrical cable. The seal waterproofs the extended portion of the coated electrical cable in the molded connector main body without using adhesive, thereby restraining production cost.

Forming a seal in the molded connector is difficult. However, the seal can be provided relatively easily on the inner surface of the separate cap.

The seal member may include a cable seal portion for sealing an outer periphery of the coated electrical cable and a molded seal portion for sealing an outer periphery of the support. The molded seal portion for sealing the outer periphery of the support waterproofs the extended portion of the coated electrical cable more surely.

A boundary between the cable seal portion and the molded seal portion may define a step. The support is provided at an extended end of the cable and may have a small diameter portion. The molded seal portion closely contacts an outer periphery of the small diameter portion and the step at the boundary between the cable seal portion and the molded seal portion contacts an end of the small diameter portion when the cap is attached to the support to seal the molded connector more positively.

An inner periphery of the seal may have annular projections extending in a peripheral direction. The cap closely contacts the seal and collapses the annular projections to seal the molded connector more positively.

The support preferably has latching projections that engage in latching apertures in the cap to define a simple structure for ensuring that the cap does not disengage from the molded connector main body.

The invention provides a molded connector with a low production cost and a good waterproofing function.

DETAILED DESCRIPTION OF THE PREFERRED EMBODIMENTS

A molded connector in accordance with the invention is identified generally by the numeral 20 in FIGS. 1 to 12. The molded connector 20 is disposed on a path for supplying an electrical power to a motor (not shown) to be mounted on a hybrid car or the like and is attached to an equipment side connector 10 provided on a metallic motor casing (not shown). A vertical direction designates upper and lower sides in FIG. 2 and a horizontal direction designates right and left sides in FIG. 2.

Figure 2:
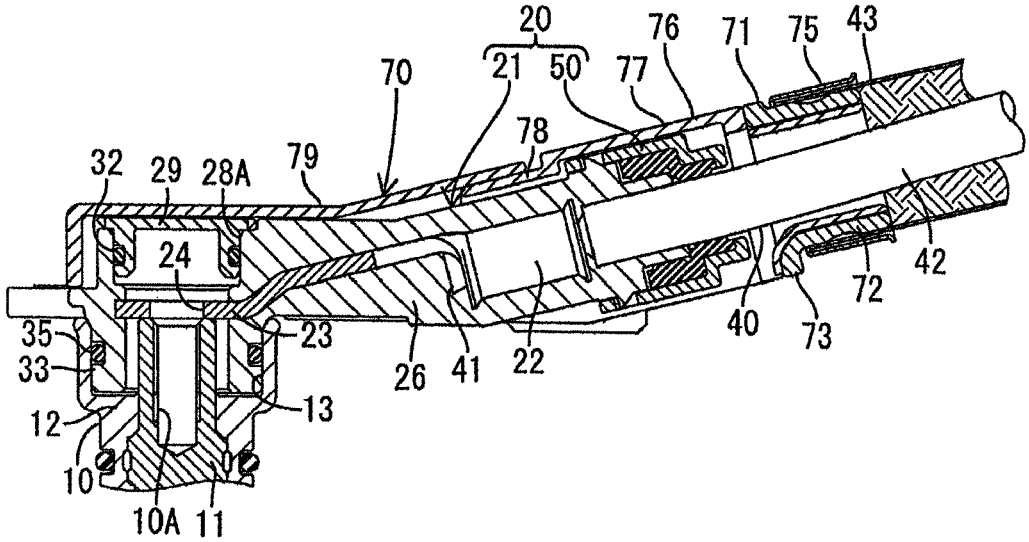
FIG. 2 is a longitudinal section view of the molded connector, illustrating the coupled state of the molded connector with the instrument side connector.
Figure 3:
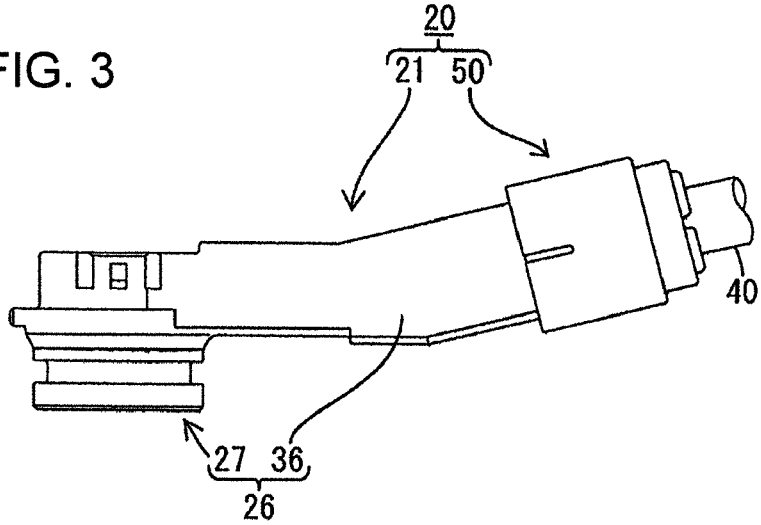
FIG. 3 is a side elevation view of the molded connector.

The equipment side connector 10 includes an equipment side terminal 11 provided with a screw hole 10A, and a synthetic resin housing 12 that contains the equipment side terminal 11, as shown in FIG. 2. The equipment side connector 10 is inserted into and secured in a through-hole (not shown) provided in the motor casing. The housing 12 has a fitting recess 13 that opens upward. The equipment side terminal 11 is contained in a central part of the fitting recess 13.

Figure 1:
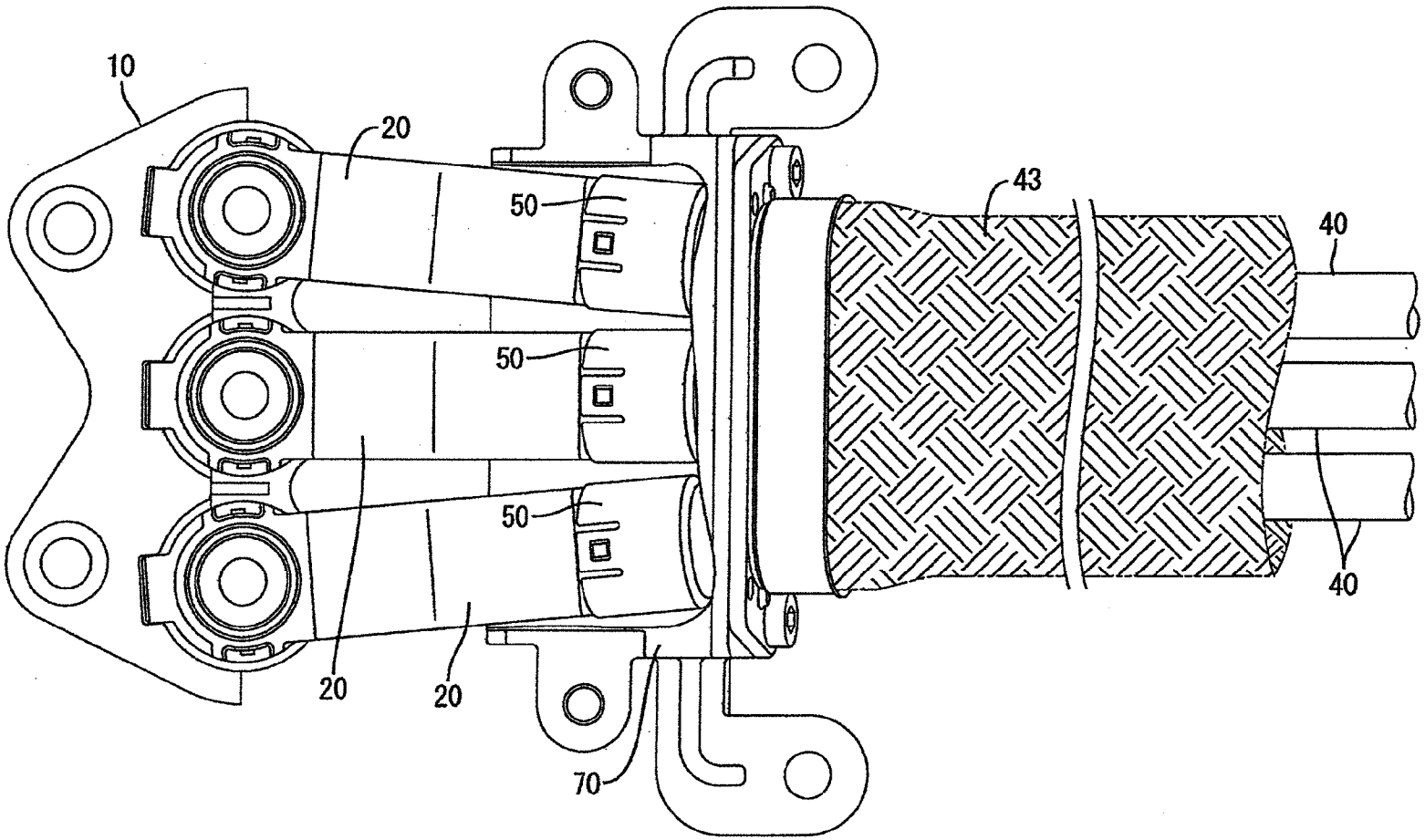
FIG. 1 is a partially broken-away plan view of a molded connector in accordance with the invention coupled with an instrument side connector.

As shown in FIG. 1, the equipment side connector 10 is configured to receive three molded connectors 20 and a coated electrical cable 40 extends from each molded connector 20. The cables 40 are bundled and shielded by a braided wire 43.

Figure 4:
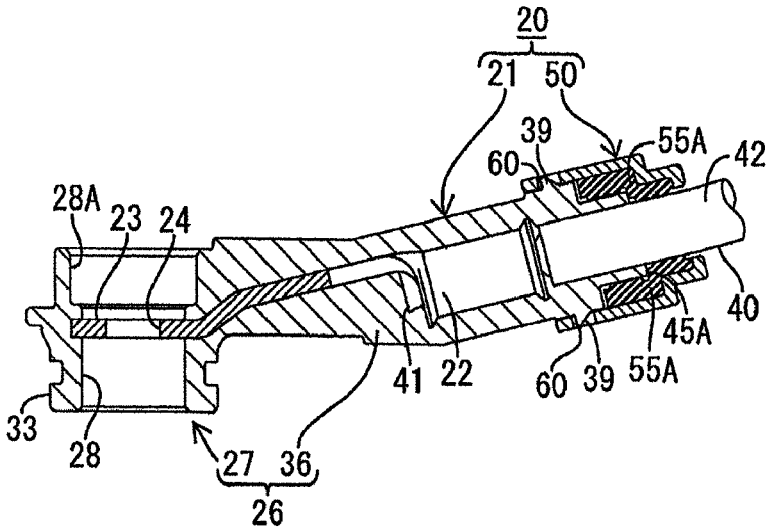
FIG. 4 is a longitudinal section view of the molded connector.

As shown in FIG. 4, each molded connector 20 includes a molded connector main body 21 and a cap 50 adapted to be attached to an end of the main body 21 at an extending side of the coated electrical cable 40.

The molded connector main body 21 includes a metallic terminal 22 attached to an end of the coated electrical cable 40 and a molded resin section 26 molded around the terminal 22 and the end of the cable 40 including part of an insulation sheath 42.

The terminal 22 is formed by bending a conductive metallic sheet and has opposite front and rear ends. A connecting portion 23 is formed at the front end of the terminal 22 and is configured to be coupled to the equipment side terminal 11. A bolt insertion aperture 24 is provided in the connecting portion 23 and can receive a bolt. A barrel-shaped press-contact portion is formed at the rear end of the terminal 22 and is configured to be crimped on an exposed core wire 41 (FIGS. 2, 4, 5) of the cable 40 from which the insulation sheath 42 has been stripped. Three terminals 22 have the same shapes and size so that they can be connected to three-phase windings of a motor.

The molded resin section 26 is made of synthetic resin and includes a head 27 to be coupled to a mating terminal and an extension 36 that projects back from the head 27. The head 27 is substantially barrel-shaped and has a through-hole 28 (FIGS. 4, 5) extending in a vertical direction. The through-hole 28 has an upper receiving part 28A into which an inner lid 29 is fit.

As shown in FIG. 2, a lower end of the inner lid 29 has a bolt recess for receiving a head of a bolt (not shown) that secures the connecting portion 23 of the terminal 22 to the equipment side terminal 11. A sealing groove is formed in the outer periphery of the inner lid 29 and a seal ring 32 is mounted in the seal groove.

A connector fitting part 33 is defined at a lower end of the head 27 and can be coupled to the fitting recess 13 in the equipment side connector 10. A seal groove is provided in an outer periphery of the connector fitting part 33 and a seal ring 35 (FIG. 2) is mounted in the seal groove.

Figure 5:
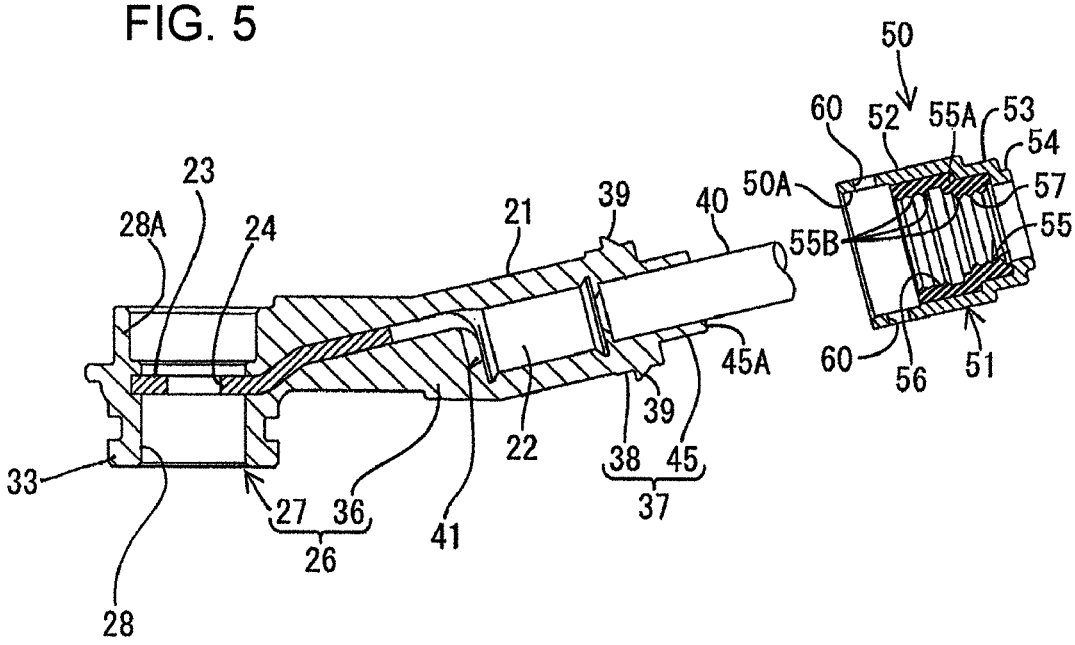
FIG. 5 is an exploded longitudinal section view of the molded connector, illustrating a molded connector main body and a cap section.
Figure 6:
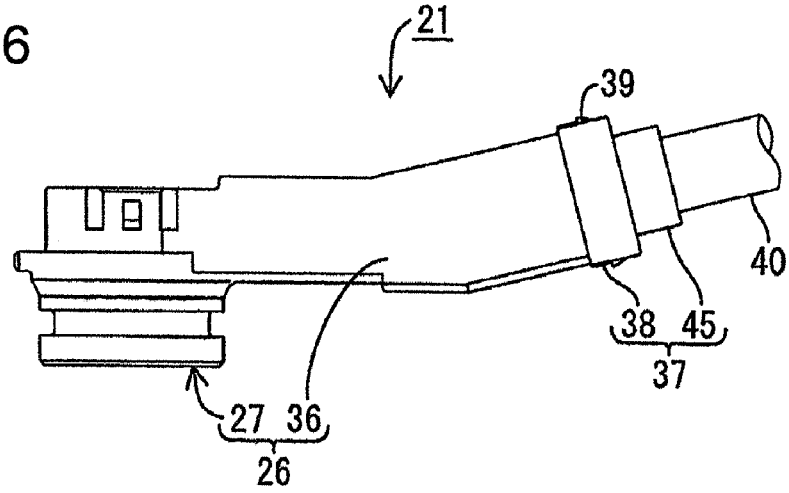
FIG. 6 is a side elevation view of the molded connector main body.
Figure 7:
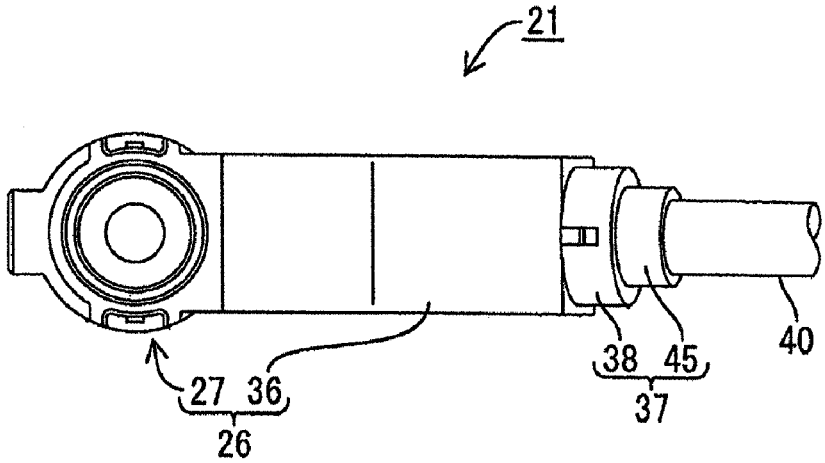
FIG. 7 is a top plan view of the molded connector main body.

As shown in FIG. 5, the extension 36 extends back from an upper part of the head 27 and is slightly slanted up from an intermediate part to a rear end in an axial direction.

The press-contact portion of the terminal 22 is crimped onto the end of the cable 40 and is molded in the extension 36.

A rear end of the extension 36 is connected to a support section 37 on which the cap 50 is mounted.

The support section 37 includes a circular portion 38 continued from an outer periphery of the extension 36, and a smaller diameter portion 45 that decreases a diameter at a rear end of the circular portion 38 in a stepped manner.

Latches 39 project from upper and lower sides of the circular portion 38 (FIG. 5). Each latch 39 increases in height from a front end to an outer periphery of the extension 36 in a stepped manner and decreases in height from there back in a slanted manner.

The smaller diameter portion 45 has a barrel shape configured to cover an outer periphery of the insulation sheath 42 of the cable 40. Additionally, the smaller diameter portion 45 is thin and has a low stiffness so that the small diameter portion 45 can be deformed in association with movement of the cable 40 without causing a significant clearance between the cable 40 and the smaller diameter portion 45.

The molded connector main body 21 is formed by first crimping the terminal 22 onto the end of the cable 40. The terminal 22 then is set in a mold (not shown) and molten resin is injected into the mold at a high pressure to form the molded connector main body 21.

As shown in FIG. 5, the cap section 50 is formed into a cylindrical shape with an insertion hole (electrical cable passing hole) 50A. The cap section 50 includes a synthetic resin barrel 51 and a rubber seal 55 that closely contacts an inner periphery of the barrel 51.

The barrel 51 has a substantially constant thickness. A large diameter portion 52 is at the front end of the barrel 51 and is to be fit closely on the circular portion 38 of the support section 37. A first small diameter portion 53 is stepped inward at the rear end of the large diameter portion 52 and projects toward the rear. A second small diameter portion 54 is stepped inward at the rear end of the first small diameter portion 53 and projects toward the rear end of the barrel 51.

Figure 10:
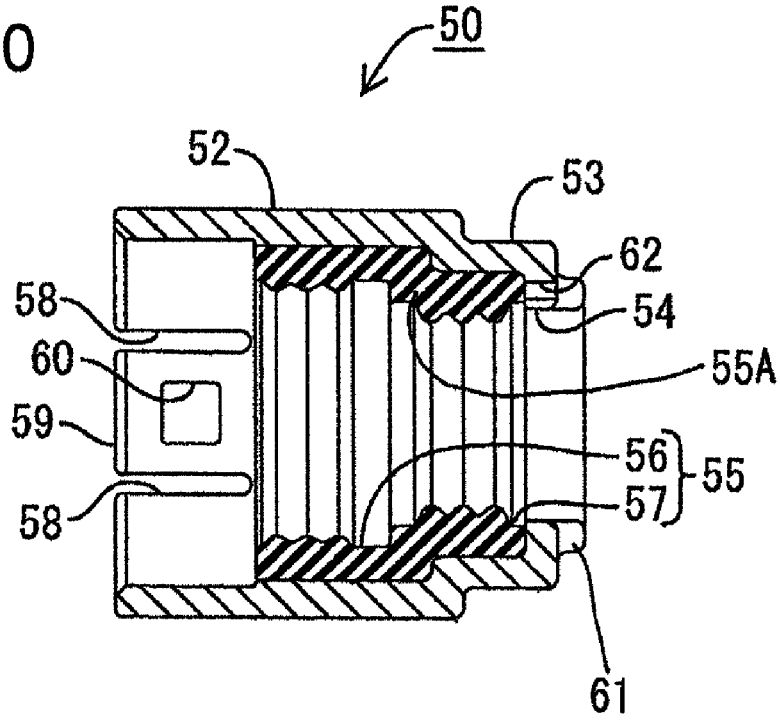
FIG. 10 is a longitudinal section view of the cap section.
Figure 11:
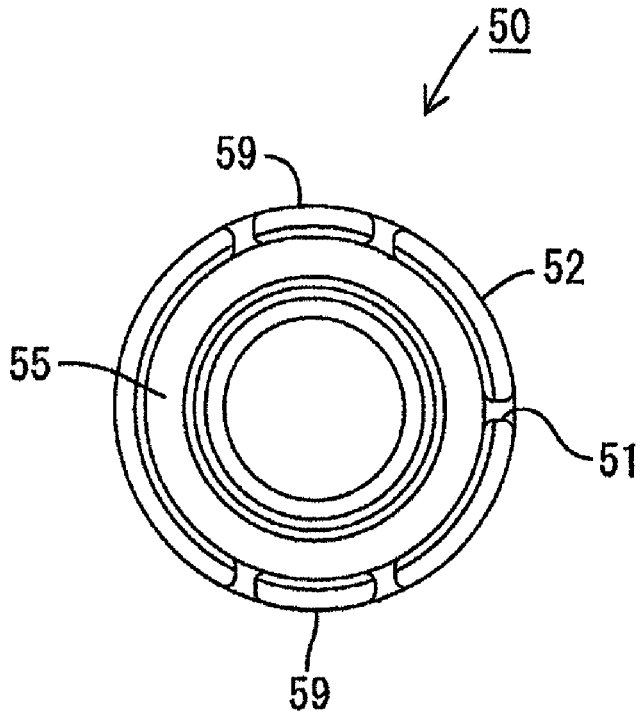
FIG. 11 is a front side elevation view of the cap section.

Slits 58 extend axially on each of the upper and lower sides of the barrel 51 to form latches 59, as shown in FIG. 10. A square latching aperture 60 is provided in an intermediate part of each latch 59.

Figure 8:
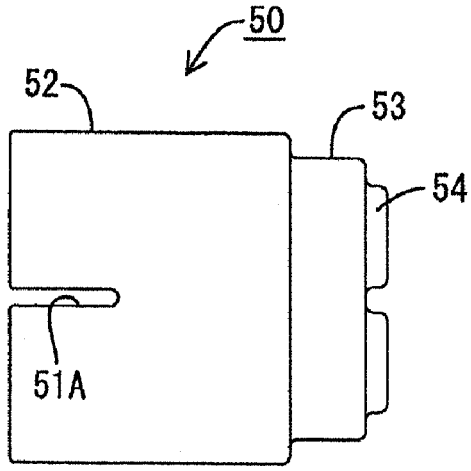
FIG. 8 is a side elevation view of the cap section.

As shown in FIG. 8, the barrel 51 is provided on one (a right side in FIG. 11) out of right and left sides with a single slit 51A extending in the axial direction.

Figure 9:
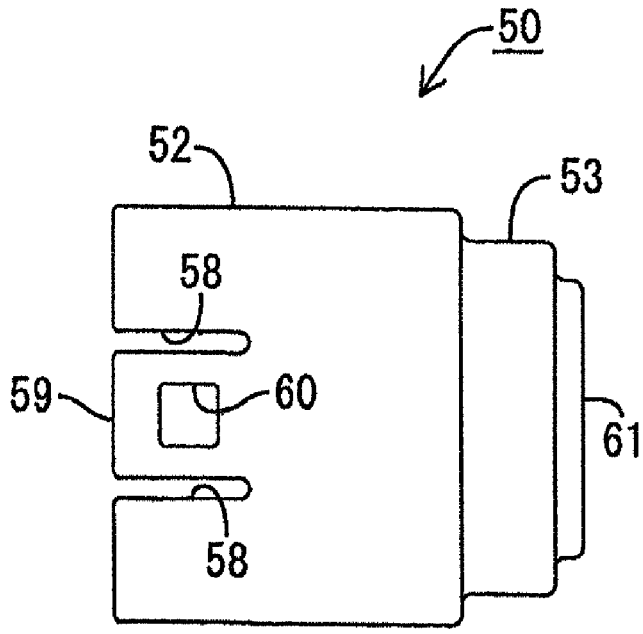
FIG. 9 is a top plan view of the cap section.
Figure 12:
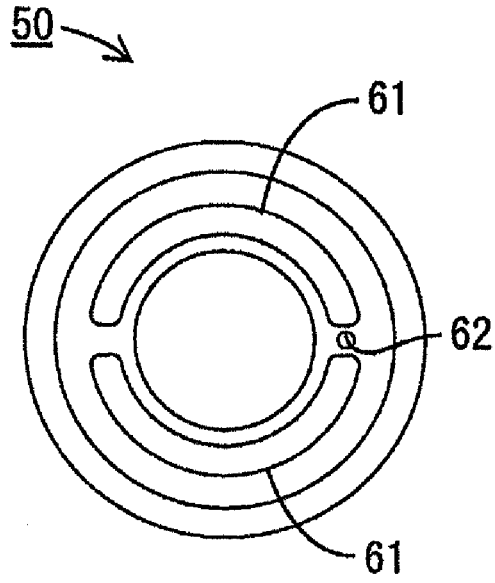
FIG. 12 is a rear side elevation view of the cap section.

Annular projections 61 protrude slightly back from the rear end of the second small diameter portion 54 to the rear end of the barrel 51, as shown in FIGS. 9 and 12, to define a rear entry to the insertion aperture 50A. The annular projection 61 has a shape in which only intermediate portions in the vertical direction do not protrude. A circular aperture gate 62 is provided on one side of the annular projection 61. The gate 62 enables injection of a rubber material to form the seal 55 after forming the barrel 51.

As shown in FIG. 5, the seal 55 has a substantially constant thickness and includes a molded seal portion 56 for sealing an outer periphery of the small diameter portion 45 of the support section 37, and a cable seal portion 57 that is stepped to a smaller diameter at a rear end of the molded seal portion 56 for sealing an outer periphery of the cable 40.

The outer periphery of the molded seal portion 56 closely contacts an inner periphery of the large diameter portion 52 of the barrel 51 while the outer periphery of the cable seal portion 57 closely contacts an inner periphery of the first small diameter portion 53 of the barrel 51.

A diameter of the insertion aperture 50A in the molded seal portion 56 is determined so that the inner periphery of the molded seal 56 closely contacts the outer periphery of the small diameter portion 45 of the support section 37, when the cap 50 is attached to the support section 37 of the molded connector main body 21. On the other hand, a diameter of the insertion aperture 50A in the cable seal portion 57 is determined so that the inner periphery of the cable seal 57 closely contacts the insulation sheath 42 of the cable 40.

A rear end of the cable seal portion 57 engages the second small diameter portion 54 convexed in at the rear end of the barrel 51.

Annular projections 55B protrude in at axially spaced positions along the whole inner periphery of the seal 55. Thus, the inner periphery of the seal 55 has projections and depressions in the axial direction. When the cap 50 is attached to the support 37, the annular projections 55B are compressed between the barrel 51 and either the small diameter portion 45 or the cable 40, depending on the axial position.

A leading end of the barrel 51 contacts the latching projections 39 as the cap 50 is approached to and fit into the support section 37. Thus, the latches 59 of the barrel 51 deflect out. The latching pieces 59 return to the original states when the latching projections 39 reach the latching apertures 60 and the latching projections 39 engage edges around the latching apertures 60, as shown in FIG. 4. At this time, the step 55A (FIG. 5) at a boundary between the cable seal portion 57 and the molded seal portion 56 contacts an end 45A of the small diameter portion 45.

The cap 50 may be produced by forming the seal 55, disposing the seal 55 in a mold, and then injecting resin into the mold to form the barrel 51 around the seal 55.

As shown in FIG. 1, the three molded connectors 20 are shielded by a metallic shield shell 70 and the three coated electrical cables 40 led out from the three molded connectors 20 are bundled together and shielded by the braided wire 43.

As shown in FIG. 2, the shield shell 70 includes a shield barrel 71 to which an end of the braided wire 43 is connected. A shell connecting portion 76 is connected to the shield barrel 71 for covering a rear end of the molded connector 20. A shell main body 79 covers a leading end of the molded connector 20 and a rear end of the shell main body 79 is superimposed on the shell connecting portion 76.

The shield barrel 71 includes a barrel main body 72 with an electrical cable insertion aperture for receiving the coated electrical cable 40. A flange 73 protrudes out from the entire periphery of the barrel main body 72. A front surface of the flange 73 contacts a rear surface of the shell connecting portion 76 and is secured to the shell connecting portion 76 by a screw that passes through a screw hole in the flange 73. A buffer made of an insulation material is provided in an inner periphery the shield barrel 71 to prevent the insulation sheath 43 from being damaged even if the cable 40 contacts with the shield barrel 71.

The shell connecting portion 76 has a cap shield 77 and a lapping portion 78. The cap shield 77 covers from an upper side a portion to which the cap 50 is attached. The lapping portion 78 is superimposed on the shell main body 79 and decreases a height from the cap shield 77 to the front.

The shell main body 79 covers a front end of the shell connecting portion 76 on the molded resin section 26 from an upper side.

An end of the braided wire 43 is covered on the outer periphery of the barrel main body 72 of the shield barrel 71 and a calking ring 75 is crimped onto the outer periphery of the braided wire 43 that covers the barrel main body 72. Thus, the braided wire 43 and shield barrel 71 are electrically continuous with each other.

The terminal 22 is superimposed on the equipment side terminal 11. A bolt then is inserted into the bolt insertion hole 24 in the terminal 22 and is fastened onto the equipment side terminal 11 to couple the connector fitting portion 33 at the head 27 of the molded connector 20 to the fitting recess 13 in the equipment side connector 10. The inner lid 29 then is put onto the bolt, the shield shell 70 is put onto the molded connector 20, and the shield shell 70 is secured to the outer surface of the motor casing.

The seal 55 on the inner surface of the cap 50 seals the outer periphery of the cable 40 when the cap 50 is attached to the support section 37 of the molded connector main body 21 to waterproof the portion of the cable 40 in the molded connector main body 21. This waterproofing of the portion of the cable 40 in the molded connector main body 21 is achieved without adhesive, thereby restraining production cost.

It would be difficult to form a seal in the molded connector 20. However, it is relatively easy to provide the seal 55 on the inner surface of the cap 50, which is separate from the molded connector main body 21. Therefore, it is easy to provide the seal 55 in the molded connector 20.

The seal 55 includes the cable seal portion 57 for sealing the outer periphery of the cable 40, and the molded seal portion 56 for sealing the outer periphery of the support section 37. Thus, the outer periphery of the support section 37 also is sealed and to waterproof the extended portion of the cable 40 more surely.

The step 55A at the boundary between the cable seal portion 57 and the molded seal portion 56 contacts with the end 45A of the small diameter portion 45 when attaching the cap 50 to the molded connector main body 21. Thus, it is possible to seal the molded connector 20 more positively.

Annular projections 55B extend circumferentially around the inner periphery of the seal 55. Thus, it is possible to seal the molded connector 20 more positively by closely contacting the seal 55 with the annular projection 55B while collapsing the annular projections 55B.

The support section 37 has the latching projections 39 and the cap 50 has the latching apertures 60 that engage the latching projections 39. Thus, a simple structure prevents the cap 50 from disengaging from the molded connector main body 21.

The invention is not limited to the embodiment described above and shown in the drawings. For example, the following embodiments fall within the technical scope of the invention.

The molded connector 20 functions to supply electrical power to a motor (not shown) in the above embodiment. However, the molded connector of the invention can supply electrical power to various kinds of equipment.

The molded connector 20 is shielded by the shield shell 70 in the above embodiment. However, the shield shell may not be required.

What is claimed is:

1. A molded connector comprising:

a molded connector main body including: a coated electrical cable having a core wire and an insulation sheath covering the core wire, a portion or the insulation sheath in proximity to an end of the cable being stripped to expose the core wire, a metallic terminal having a portion secured to the core wire in proximity to the end of the coated electrical cable, and a synthetic resin molded section molded on the portion of the metallic terminal secured to the core wire of the cable and, the synthetic resin molded section including a support molded onto a portion of the insulation sheath;

a barrel-like cap having a cable insertion hole for passing the cable, the cap being attached to the molded connector main body to cover an outer periphery of the support of the molded connector main body; and an annular seal on an inner surface of the cap, the seal having a cable seal portion closely contacting and sealing an outer periphery of the cable and a molded seal portion for closely contacting and sealing an outer periphery of said support of the synthetic resin molded section.

2. A molded connector comprising:

a molded connector main body including: a coated electrical cable having a core wire and an insulation sheath covering the core wire, a portion or the insulation sheath in proximity to an end of the cable being stripped to expose the core wire, a metallic terminal having a portion secured to the core wire in proximity to the end of the coated electrical cable, and a synthetic resin molded section molded on the portion of the metallic terminal secured to the core wire of the cable, the synthetic resin molded section including a support molded onto a portion of the insulation sheath wherein the support has a small diameter portion a barrel-like cap having a cable insertion hole for passing the cable, the cap being attached to the molded connector main body to cover an outer periphery of the support of the molded connector main body; and an annular seal on an inner surface of the cap, the seal includes a cable seal portion for closely contacting and sealing an outer periphery of the cable, and a molded seal portion for sealing an outer periphery of said support of the molded connector main body, the seal includes a step at a boundary between the cable seal portion and the molded seal portion, the molded seal portion closely contacting an outer periphery of said small diameter portion when the cap is attached to the support, and the step at the boundary between the cable seal portion and the molded seal portion contacts an end of the small diameter portion.

3. The molded connector of claim 2, wherein annular projections extend circumferentially around an inner periphery of the seal.

4. The molded connector of claim 2, wherein the support has latching projections, and the cap has latching apertures that engage said latching projections.

5. A molded connector comprising:

a coated electrical cable having a core wire and an insulation sheath covering the core wire, a portion or the insulation sheath in proximity to an end of the cable being stripped to expose the core wire;

a metallic terminal having a portion secured to the core wire in proximity to the end of the coated electrical cable;

a synthetic resin molded section having an extension molded on the portion of the metallic terminal secured to the core wire of the cable and a support molded onto a portion of the insulation sheath, the support having a small diameter portion at an end remote from the extension;

an annular seal including a molded seal portion mounted around the small diameter portion of the support of the synthetic resin molded section for sealing the outer periphery of said support, a cable seal portion mounted and around a section of the insulation sheath extending beyond the support; for sealing the outer periphery of the cable, and a step at a boundary between the cable seal portion and the molded seal portion; and a barrel-like cap covering an outer periphery of the seal and an outer periphery of a support of the molded connector main body.

6. The molded connector of claim 5, wherein the molded seal portion closely contacts an outer periphery of said small diameter portion when the cap is attached to the support, and the step at the boundary between the cable seal portion and the molded seal portion contacts an end of the small diameter portion.

7. The molded connector of claim 6, wherein the support has latching projections, and the cap has latching apertures that engage said latching projections.

* * * * *